US007542691B2

(12) United States Patent
Yoda

(10) Patent No.: US 7,542,691 B2
(45) Date of Patent: Jun. 2, 2009

(54) IMAGE FORMING APPARATUS

(75) Inventor: Junya Yoda, Osaka (JP)

(73) Assignee: Kyocera Mita Corporation (JP)

( * ) Notice: Subject to any disclaimer, the term of this patent is extended or adjusted under 35 U.S.C. 154(b) by 442 days.

(21) Appl. No.: 11/390,331

(22) Filed: Mar. 27, 2006

(65) Prior Publication Data

US 2006/0222395 A1 Oct. 5, 2006

(30) Foreign Application Priority Data

Mar. 29, 2005 (JP) ..... 2005-095152

(51) Int. Cl.
*G03G 15/20* (2006.01)

(52) U.S. Cl. ..... 399/69; 399/70

(58) Field of Classification Search ..... 399/67, 399/69, 70

See application file for complete search history.

(56) References Cited

U.S. PATENT DOCUMENTS

2006/0039713 A1* 2/2006 Kishi et al. ..... 399/69

FOREIGN PATENT DOCUMENTS

JP 10-282821 10/1998

* cited by examiner

*Primary Examiner*—David M Gray
*Assistant Examiner*—Erika Villaluna
(74) *Attorney, Agent, or Firm*—Gerald E Hespos; Anthony J Casella

(57) ABSTRACT

A machine (1) has a capacitor switch (20) for switching between a side to drive a first fixing heater (17) by a capacitor (18), and a side to charge the capacitor (18). A battery switch (25) switches between a side to drive a second fixing heater (22) by a battery (23), and a side to charge the battery (23). A heater switch (27) drives a third fixing heater (26). A judger (152) judges whether the machine (1) is in a first condition requiring a rapid raise in the temperature of a fixing section, or a second condition requiring a maintained temperature of the fixing section. A controller (153) energizes all three fixing heaters (17, 22, 26) when the machine (1) is in the first condition, and energizes the second and third fixing heaters (22, 26) while charging the capacitor (18) when the machine (1) is in the second condition.

7 Claims, 7 Drawing Sheets

FIG.2

| FROM | EVENT | TO |
|---|---|---|
| | POWER ON | INITIAL STARTUP CONDITION |
| INITIAL STARTUP CONDITION | TEMPERATURE OF FIXING ROLLER REACHED PREDETERMINED TEMPERATURE | READY CONDITION |
| READY CONDITION | PRINT DESIGNATION ACCEPTED | PRINT CONDITION |
| READY CONDITION | CERTAIN TIME LAPSED | SLEEP CONDITION |
| PRINT CONDITION | PRINTING COMPLETED | READY CONDITION |
| SLEEP CONDITION | PRINT DESIGNATION ACCEPTED | RAPID RECOVERY CONDITION |
| RAPID RECOVERY CONDITION | TEMPERATURE OF FIXING ROLLER REACHED PREDETERMINED TEMPERATURE | PRINT CONDITION |

FIG.3

| CONDITION | SWITCH OPERATION |
|---|---|
| INITIAL STARTUP CONDITION | CAPACITOR CHARGE/DISCHARGE SWITCH → DISCHARGING SIDE<br>BATTERY CHARGE/DISCHARGE SWITCH → CHARGING SIDE<br>BATTERY CHARGING SWITCH → SUSPENDING SIDE<br>THIRD HEATER DRIVING SWITCH → OPERATIVE SIDE |
| RAPID RECOVERY CONDITION | |
| READY CONDITION | CAPACITOR CHARGE/DISCHARGE SWITCH → CHARGING SIDE<br>CAPACITOR CHARGING SWITCH → OPERATIVE SIDE<br>BATTERY CHARGE/DISCHARGE SWITCH → CHARGING SIDE<br>BATTERY CHARGING SWITCH → OPERATIVE SIDE<br>THIRD HEATER DRIVING SWITCH → OPERATIVE SIDE |
| SLEEP CONDITION | CAPACITOR CHARGE/DISCHARGE SWITCH → CHARGING SIDE<br>CAPACITOR CHARGING SWITCH → OPERATIVE SIDE<br>BATTERY CHARGE/DISCHARGE SWITCH → CHARGING SIDE<br>BATTERY CHARGING SWITCH → OPERATIVE SIDE<br>THIRD HEATER DRIVING SWITCH → INOPERATIVE SIDE |
| PRINT CONDITION | CAPACITOR CHARGE/DISCHARGE SWITCH → CHARGING SIDE<br>CAPACITOR CHARGING SWITCH → INOPERATIVE SIDE<br>BATTERY CHARGE/DISCHARGE SWITCH → DISCHARGING SIDE<br>THIRD HEATER DRIVING SWITCH → OPERATIVE SIDE |

IMAGE FORMING APPARATUS

BACKGROUND OF THE INVENTION

1. Field of the Invention

The present invention relates to an image forming apparatus for fixing toner onto a recording sheet by application of heat.

2. Description of the Related Art

In conventional image forming apparatuses, a fixing heater is heated by using a commercial power source. Also, in recent years, as an energy saving measure, proposed is an image forming apparatus with an energy saving mode at which power supply to the fixing heater is suspended. In the image forming apparatus provided with the energy saving mode, once the apparatus enters the energy saving mode, power supply to the fixing heater is temporarily suspended, with the result that the temperature of the fixing heater falls below a predetermined temperature suitable for image fixation. Accordingly, a waiting time, i.e., a temperature-recovering time for raising the temperature of the fixing heater to the predetermined temperature suitable for image fixation is required to return the apparatus from the energy saving mode to a print mode.

In view of the above, there has been proposed an image forming apparatus with a shortened waiting time by maintaining the temperature of the fixing heater in the energy saving mode at a temperature slightly lower than the temperature of the fixing heater suitable for image fixation during printing.

Use of a large electric power enables to quickly raise the temperature of the fixing heater. However, in light of the fact that the commercial power source available in Japan is 1,500 W at maximum, with the voltage of 100V and the current of 15 A, the use of the large electric power is normally impossible. Japanese Unexamined Patent Publication No. 10-282821 discloses a heating device with an enhanced energy saving effect, or an image forming apparatus provided with the heating device, wherein a chargeable sub power source such as a capacitor or a battery is provided, the sub power source is charged by a commercial power source while the apparatus is in the energy saving mode, and a large electric current is allowed to flow through the fixing heater by using both the commercial power source and the sub power source at the time of returning the apparatus from the energy saving mode to the print mode to shorten the temperature-recovering time. In the arrangement, the enhanced energy saving effect is secured because the temperature-recovering time can be shortened even if the temperature of the fixing heater at the energy saving mode is set significantly lower than the temperature of the fixing heater suitable for image fixation.

Also, there is known an image forming apparatus designed such that an electric power is supplied through two power source outlets simultaneously in place of using the sub power source.

In the conventional image forming apparatus, when a long-time printing is conducted, there is likelihood that the temperature of the fixing heater may fall below a predetermined temperature suitable for image fixation during the long-time printing.

The following is a description on features about an electric dual layer capacitor, which is a suitable capacitor example as the sub power source, and a lithium ion battery, which is a suitable battery example as the sub power source.

The electric dual layer capacitor is chargeable and dischargeable with a large electric current, and has a relatively long useful life with durability of repeated charging and discharging operations in the order of, e.g., about several hundred thousand times, yet with a drawback that the voltage rapidly falls. In view of this, it is necessary to make the capacity of the capacitor large in order to supply an electric power for a long time, which is costly. The time required for charging the electric dual layer capacitor is, e.g. several ten seconds.

The lithium ion battery has a merit that voltage fall is significantly small until an end stage of discharging. Therefore, as compared with the electric dual layer capacitor, long-time power supply is realized with a less cost. The lithium ion battery, however, has a demerit that its useful life may be shortened if charging and discharging operations are repeated with a large electric current. In the case where a halogen heater, which is used as the fixing heater, is energized from a state where the temperature of the halogen heater is lowered to ambient temperature, an in-rush current, e.g., a large current of about ten times as large as a rated current may rapidly flow through the halogen heater. If the lithium ion battery is used in the above state, the useful life of the lithium ion battery may be shortened to such an extent that a possible maximal number of repeatedly performing charging and discharging operations may be decreased to about 500 to 1,000 times. The time required for charging the lithium ion battery is about 10 minutes, for instance.

It is desirable to allow a large current to flow into the fixing heater for a long time from the point of time when the apparatus is recovered from the energy saving mode to the print mode until the time of completion of printing, with use of a sub power source as well as a main power source during the printing, in order to prevent the temperature of the fixing heater in the printing operation from falling below a predetermined temperature suitable for image fixation, and to keep the temperature of the fixing heater at the energy saving mode as low as possible, yet shortening a temperature-recovering time required for the apparatus to recover from the energy saving mode to the print mode. However, in light of the demerit of the electric dual layer capacitor that the voltage thereof rapidly falls once a discharging operation starts, in use of the electric dual layer capacitor as the sub power source, a measure is necessary to provide the electric dual layer capacitor with durability of long-time use. The measure is provided by making the capacity of the electric dual layer capacitor large, which, however, is costly.

The lithium ion battery has the demerit that its useful life may be shortened by repeated charging and discharging operations with a large current. In use of a halogen heater in a fixing roller, a large current may flow through the halogen heater in the case where the halogen heater is energized from the state where its temperature is lowered close to the ambient temperature. Accordingly, use of the lithium ion battery as the sub power source in order to rapidly heat the fixing heater, whose temperature has been lowered close to the ambient temperature, may shorten the useful life of the lithium ion battery.

SUMMARY OF THE INVENTION

In view of the above problems residing in the prior art, it is an object of the present invention to provide an image forming apparatus which enables to shorten the temperature-recovering time required for recovering the temperature of a fixing roller to a fixing temperature suitable for image fixation, and to eliminate unduly lowering of the fixing temperature of the fixing roller during printing, with a reduced production cost and without likelihood of shortening the useful life of a sub power source.

To accomplish the object, an aspect of the invention is directed to an image forming apparatus comprising: a first sub power source including a capacitor; a second sub power source including a secondary battery; a first fixing heater for heating a fixing section to fix toner onto a recording sheet by an electric power supplied from the first sub power source; a second fixing heater for heating the fixing section by an electric power supplied from the second sub power source; a third fixing heater for heating the fixing section by an electric power supplied from an external power source as a main power source; a first charging switch for switching over charging and charge-suspending of the first sub power source; a second charging switch for switching over charging and charge-suspending of the second sub power source; a first charging/discharging switch for switching over discharging of the first sub power source to drive the first fixing heater, and charging of the first sub power source; a second charging/discharging switch for switching over discharging of the second sub power source to drive the second fixing heater, and charging of the second sub power source; a third heater driving switch for switching over driving of the third fixing heater by the electric power supplied from the external power source, and drive-suspending of the third fixing heater; an apparatus condition judger for judging whether the image forming apparatus is in a first condition where a rapid temperature rise is required to rapidly raise a temperature of the fixing section to a predetermined first temperature zone, or in a second condition where the temperature of the fixing section is required to be maintained in the first temperature zone; and a controller for controllably switching the first charging/discharging switch to the discharging, the second charging/discharging switch to the charging, the second charging switch to the charge-suspending, and the third heater driving switch to the driving when the apparatus condition judger judges that the apparatus is in the first condition, and for controllably switching the first charging/discharging switch to the charging, the first charging switch to the charge-suspending, the second charging/discharging switch to the discharging, and the third heater driving switch to the driving when the apparatus condition judger judges that the apparatus is in the second condition.

With this arrangement, in the case where the temperature of the fixing section is required to be rapidly raised to the first temperature zone by supply of a large electric current to the image forming apparatus in a short period, the first and third fixing heaters are driven by the power supply from the external power source and from the first sub power source. In the case where the temperature of the fixing section is required to be maintained in the first temperature zone by supply of a relatively small electric current to the image forming apparatus for a long period, the second and third fixing heaters are driven by the power supply from the external power source and from the second sub power source. This arrangement enables to shorten the time required for the temperature of the fixing section to be raised to the first temperature zone, and to maintain the temperature of the fixing section in the first temperature zone. Since there is no likelihood that a large electric current may flow through the second sub power source, this arrangement eliminates unduly shortening of the useful life of the second sub power source. Also, providing the second sub power source eliminates the need that a large current should flow through the first sub power source for a long period. This arrangement eliminates use of a first sub power source with a large capacity or a costly first sub power source. Also, since this arrangement prevents the first and second sub power sources from being charged by the external power source when the image forming apparatus is in the first or second condition, the external power source is dedicatedly used for driving the third fixing heater, thereby securing an electric power sufficient for driving the third fixing heater.

These and other objects, features and advantages of the present invention will become more apparent upon reading of the following detailed description along with the accompanying drawings.

BRIEF DESCRIPTION OF THE DRAWINGS

FIG. 2 is a lookup table showing condition-event relations information in the composite machine.

FIG. 3 is a lookup table showing information relating to correlations between operations of various switches in the composite machine, and operation conditions of the composite machine.

DETAILED DESCRIPTION OF THE PREFERRED EMBODIMENTS

Figure 1:
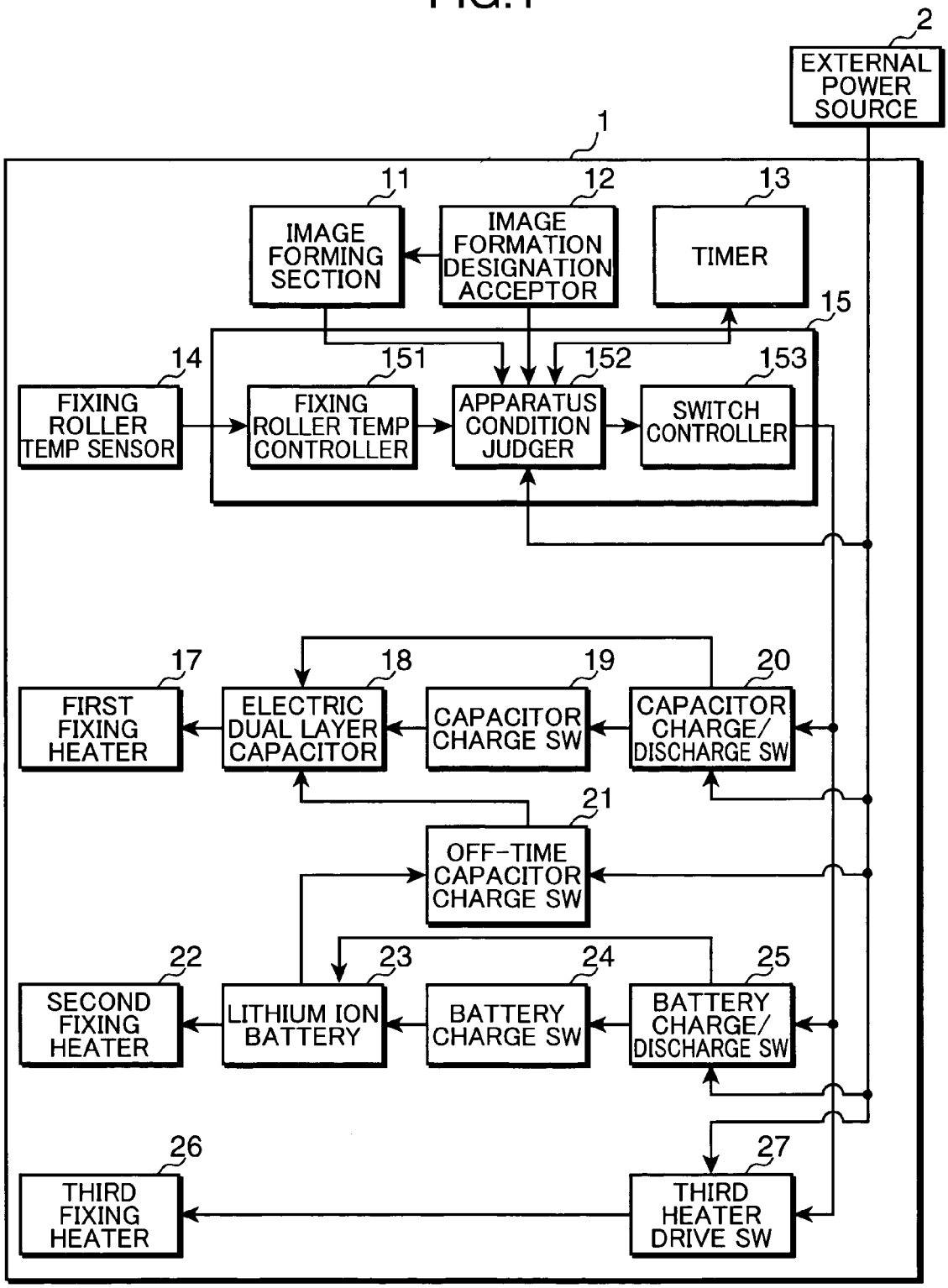
FIG. 1 is a block diagram showing a functional arrangement of a composite machine as an embodiment of the invention.

In the following, an embodiment of the invention is described referring to the drawings. FIG. 1 is an illustration showing a functional arrangement of a fixing heater control mechanism for use in an image forming apparatus such as a printer, a copier, a fax machine, or a composite machine having functions of the printer, the copier, and the fax machine, according to an embodiment of the invention. The fixing heater control mechanism is adapted to control energizing and de-energizing of a fixing heater for heating a fixing roller. The fixing roller (not shown) is adapted to nip a recording sheet carrying a toner image in cooperation with a pressure roller (not shown) to fix the toner onto the recoding sheet by application of heat and a pressure.

An external power source 2 is, for instance, a commercial power source, which is an alternate current (AC) power source supplied from an electric power company.

In the embodiment, description is made on a composite machine as an example of the image forming apparatus. The composite machine 1 includes an image forming section 11, an image formation designation acceptor 12, a timer 13, a fixing roller temperature sensor 14, a main controller 15, a first fixing heater 17, an electric dual layer capacitor 18 (hereinafter, simply called as "capacitor 18"), a capacitor charging switch 19 (hereinafter simply called as "switch 19"), a capacitor charging/discharging switch 20 (hereinafter simply called as "switch 20"), an off-time capacitor charging switch 21 (hereinafter simply called as "switch 21"), a second fixing heater 22, a lithium ion battery 23, a battery charging switch 24 (hereinafter simply called as "switch 24"), a battery charging/discharging switch 25 (hereinafter simply called as "switch 25"), a third fixing heater 26, and a third heater driving switch 27 (hereinafter simply called as "switch 27").

The image forming section 11 is adapted to form a toner image onto a recording sheet. In the composite machine 1, the image forming section 11 is operated as intended when a copying function, a printing function, or a fax data receiving function is executed, for instance.

The image formation designation acceptor 12 is adapted to accept a designation on image formation by an operator, i.e., a designation to execute a copying function, a printing function, or a fax data receiving function. In executing the copying function, the image formation designation acceptor 12 accepts operator's designation to execute the copying function by way of an operation panel (not shown) of the composite machine 1. In executing the printing function, the image formation designation acceptor 12 accepts operator's designation to execute the printing function through, e.g., a personal computer (PC) connected to the composite machine 1 via a network or the like. In executing the fax data receiving function, the image formation designation acceptor 12 accepts operator's designation to receive fax data sent from a fax machine connected to the composite machine 1 by a public line or the like.

The timer 13 is adapted to measure a time which elapses from the moment when the timer 13 has received a judgment result from an apparatus condition judger 152. The fixing roller temperature sensor 14 is adapted to measure the temperature of the fixing roller (not shown) and output temperature data to a fixing roller temperature controller 151.

The first fixing heater 17, the second fixing heater 22, and the third fixing heater 26 are a group of heaters for heating the fixing roller. The first fixing heater 17 is a DC heater through which a direct current (DC) of 1,300 W is allowed to flow, for instance. The second fixing heater 22 is a DC heater through which a DC current of 500 W is allowed to flow, for instance. The third fixing heater 26 is an AC heater through which an alternate current (AC) of 1,200 W is allowed to flow, for instance. The first fixing heater 17 consumes a large electric power, because a large electric current is allowed to flow through the first fixing heater 17 to rapidly heat the first fixing heater 17. The first fixing heater 17, the second fixing heater 22, and the third fixing heater 26 are arranged adjacent to each other. When the first fixing heater 17 or the third fixing heater 26 is energized, the second fixing heater 22 is heated to some extent by residual heat of the first fixing heater 17 or the third fixing heater 26.

The capacitor 18 is a chargeable power source for driving the first fixing heater 17 for energization. The capacitor 18 is chargeable and dischargeable with a large current, and has a relatively long useful life with durability of repeated charging and discharging operations in the order of, e.g., about several hundred thousand times, yet with a drawback that the power or the voltage rapidly falls. The time required for charging the capacitor 18 is, e.g., several ten seconds.

The lithium ion battery 23 is a chargeable power source for driving the second fixing heater 22 for energization. The lithium ion battery 23 has a merit that that its voltage fall is significantly small until an end stage of discharging. The time required for charging the lithium ion battery is about 10 minutes, for instance.

The switch 19 is a switch for switching over between a charging side and a suspending side to charge the capacitor 18 with use of the external power source 2 or suspend the charging operation of the capacitor 18. The switch 24 is a switch for switching over between a charging side and a suspending side to charge the lithium ion battery 23 with use of the external power source 2 or suspend the charging operation of the lithium ion battery 23.

The switch 20 is a switch for switching over between a discharging side where the first fixing heat 17 is driven for energization by using the capacitor 18 as a power source, and a charging side where the capacitor 18 is charged by using the external power source 2 as a power source. In response to setting the switch 20 to the charging side in a state that the switch 19 is set to the charging side, the capacitor 18 is charged. In response to switching over the switch 20 to the discharging side, the first fixing heater 17 is driven for energization. The switch 20 is a relay switch, and is switched over to the charging side when the power supply from the external power source 2 is cut off.

The switch 25 is a switch for switching over between a discharging side where the second fixing heater 22 is driven for energization by using the lithium ion battery 23 as a power source, and a charging side where the lithium ion battery 23 is charged by using the external power source 2 as a power source. In response to setting the switch 25 to the charging side in a state that the switch 24 is set to the charging side, the lithium ion battery 23 is charged. In response to setting the switch 25 to the discharging side, the second fixing heater 22 is driven for energization. The switch 25 is a relay switch, and is switched over to the charging side when a power supply from the external power source 2 is cut off.

The switch 27 is a switch for switching over between an operative side and an inoperative side to drive the third fixing heater 26 for energization by using the external power source 2 as a power source or suspend the driving of the third fixing heater 26. In response to setting the switch 27 to the operative side, the third fixing heater 26 is driven for energization, and in response to setting the switch 27 to the inoperative side, the driving of the third fixing heater 26 is suspended.

The switch 21 is a switch for switching over between a charging side and a suspending side to charge the capacitor 18 by using the lithium ion battery 23 as a power source or suspend the charging operation of the capacitor 18 when the power supply from the external power source 2 is cut off. The switch 21 is a relay switch. In response to supply of an electric power from the external power source 2 to the composite machine 1, the switch 21 is switched over to the suspending side to suspend the charging operation of the capacitor 18 with use of the lithium ion battery 23 as a power source. In response to cut-off of the power supply from the external power source 2, the switch 21 is switched over to the charging side, thereby charging the capacitor 18 with use of the lithium ion battery 23 as a power source.

The state that the power supply from the external power source 2 is cut off includes a condition that a power cord or a power plug of the composite machine 1 is disconnected from a power source outlet, and a condition that a power switch, i.e., a main switch of the composite machine 1 is turned off. In this embodiment, in the case where the power switch of the composite machine 1 is turned off, and the power cord is connected to the power source outlet, the power from the external power source 2 is supplied merely for the purpose of charging the capacitor 18 and the lithium ion battery 23, and in the case where the power switch of the composite machine 2 is turned off, and the power cord is disconnected from the power source outlet, the capacitor 18 is charged by using the power of the lithium ion battery 23.

The main controller 15 controls overall operations of the composite machine 1, and includes a central processing unit (CPU) for executing a program, a read only memory (ROM) for storing the program, and a random access memory (RAM) which serves as a work area for temporarily storing the program for execution of the program. The main controller 15 has the fixing roller temperature controller 151, the apparatus condition judger 152, and a switch controller 153, as functional components.

The apparatus condition judger 152 judges whether the composite machine 1 is currently in an initial startup condition, print condition, ready condition, sleep condition, or rapid recovery condition.

The initial startup condition corresponds to a state of the composite machine 1 from the point of time when the main power supply to the composite machine 1 is started until the temperature of the fixing roller reaches an upper limit of a first temperature zone where image fixation is enabled, which is also called as fixing temperature zone. The print condition corresponds to a state of the composite machine 1 from the point of time when designation on printing including copying is accepted until the printing is completed. When the composite machine 1 is in the print condition, the temperature of the fixing roller lies within the first temperature zone. The ready condition corresponds to a state of the composite machine 1 where the temperature of the fixing roller lies within a second temperature zone whose upper limit is lower than a lower limit of the first temperature zone, and the composite machine 1 is not in the print condition. The sleep condition corresponds to a state of the composite machine 1 where driving of the third fixing heater 26 is suspended. The rapid recovery condition corresponds to a state of the composite machine 1 from the point of time when designation on printing is accepted while the composite machine 1 is in the sleep condition until the temperature of the fixing roller reaches the upper limit of the first temperature zone.

FIG. 2 is an illustration of a lookup table showing condition-event relations information indicating correlations between the respective operation conditions of the composite machine 1, i.e., initial startup condition, print condition, ready condition, sleep condition, and rapid recovery condition, and the types of events based on which the composite machine 1 is shifted from one condition to another. The apparatus condition judger 152 stores the condition-event relations information in advance to discriminate the current condition of the composite machine 1 from a next condition to which the composite machine 1 is supposed to shift, based on the event that occurred.

The fixing roller temperature controller 151 controls the second fixing heater 22 and the third fixing heater 26 to energize or de-energize so that the temperature of the fixing roller is kept within the predetermined first temperature zone when the composite machine 1 is in the print condition. The fixing roller temperature controller 151 acquires temperature data relating to the temperature of the fixing roller from the fixing roller temperature sensor 14, and keeps on energizing the second fixing heater 22 and the third fixing heater 26 until the temperature of the fixing roller reaches the upper limit of the predetermined first temperature zone when the composite machine 1 is in the print condition. After the temperature of the fixing roller has reached the upper limit of the first temperature zone, the fixing roller temperature controller 151 controls the second fixing heater 22 and the third fixing heater 26 to de-energize until the temperature of the fixing roller is lowered to the lower limit of the first temperature zone. The energization and de-energization of the second fixing heater 22 and the third fixing heater 26 are cyclically repeated to maintain the temperature of the fixing roller within the first temperature zone. Also, the fixing roller temperature controller 151 controls the third fixing heater 26 to energize or de-energize so that the temperature of the fixing roller is kept within the second temperature zone when the composite machine 1 is in the ready condition.

The switch controller 153 controls the various switches such as the switch 20, the switch 25, and the switch 27 to switch over the operation thereof based on the detected current condition of the composite machine 1. FIG. 3 is an illustration of a lookup table showing correlations between the respective operation conditions of the composite machine 1, and switching operations of the relevant switches.

When the composite machine 1 is in the initial startup condition or in the rapid recovery condition, an electric power sufficient for driving the third fixing heater 26 is supplied from the external power source 2 because the lithium ion battery 23 is not charged by setting the switch 24 to the suspending side where charging of the lithium ion battery 23 is suspended. When the composite machine 1 is in the print condition, an electric power sufficient for driving the third fixing heater 26 is supplied from the external power source 2 because the capacitor 18 is not charged by setting the switch 19 to the suspending side where charging of the capacitor 18 is suspended. Also, when the composite machine 1 is in the ready condition, the switch controller 153 controls the amounts to be charged for the capacitor 18 and the lithium ion battery 23 so that the total power consumption necessary for charging the capacitor 18 and the lithium ion battery 23, including the power consumption necessary for driving the third fixing heater 26 does not exceed 1,500 W. In view of this, it takes a little more time than usual when the charging operation is conducted. The switch controller 153 acquires, from the apparatus condition judger 152, information relating to the current condition of the composite machine 1, and controls the respective switches to switch over the operation thereof suitable for the detected condition of the composite machine 1.

Figure 4:
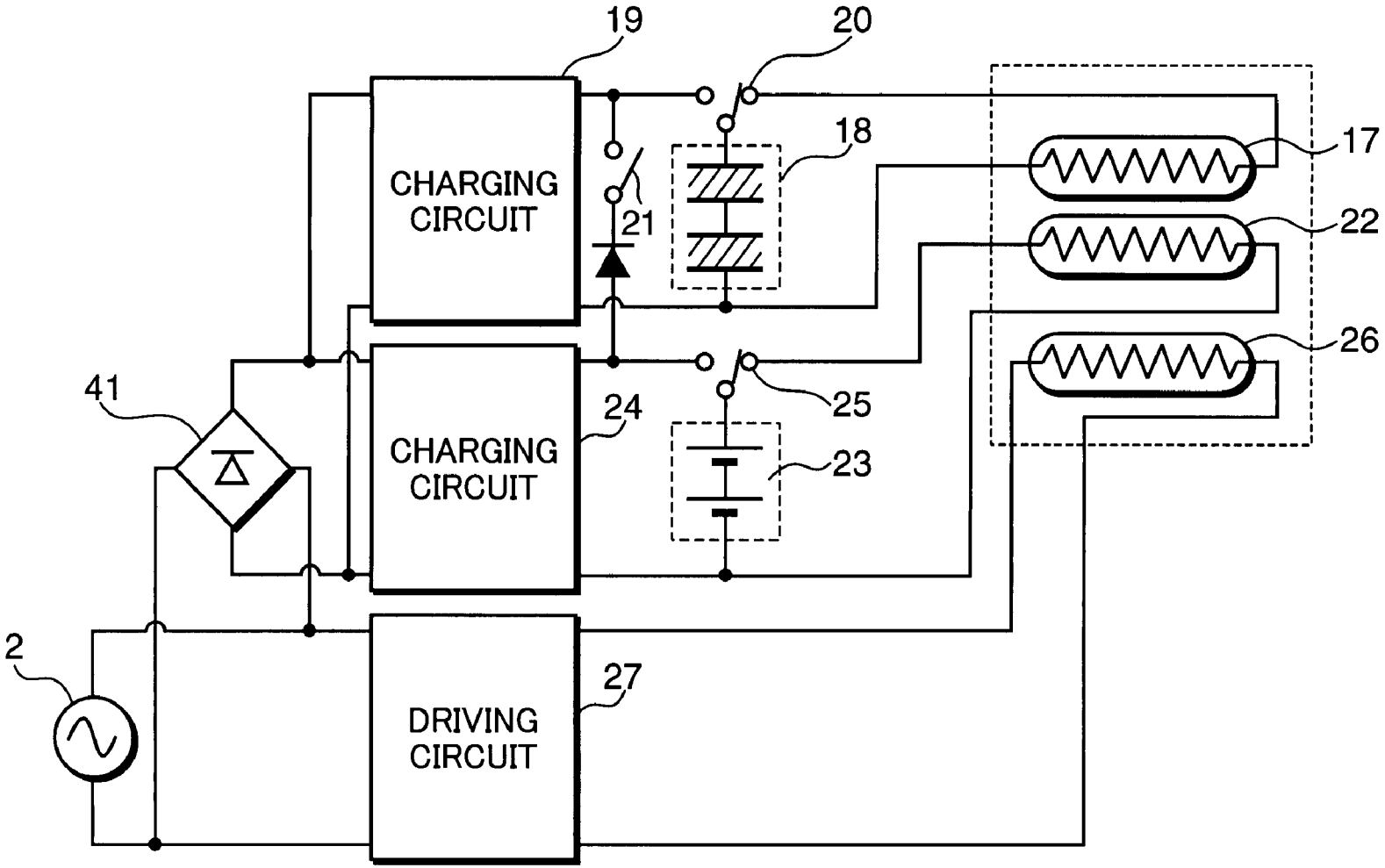
FIG. 4 is a circuit diagram schematically showing a circuit configuration of a fixing heater control mechanism to be used in the composite machine.

Now, an example of a circuit configuration of the fixing heater control mechanism for use in the composite machine 1 of the embodiment is described. FIG. 4 is a circuit diagram schematically showing the circuit of the fixing heater control mechanism.

The external power source 2 for supplying an AC current is connected to the third fixing heater 26 via a third heater driving circuit 27 corresponding to the switch 27. The external power source 2 is connected to the first fixing heater 17 and the second fixing heater 22 via a diode 41 for rectifying the AC current to a DC current. Thereby, the DC current is allowed to flow through the first fixing heater 17 and the second fixing heater 22, and the AC current is allowed to flow through the third fixing heater 26.

A circuit to be connected to the first fixing heater 17 includes the capacitor 18, a charging circuit 19 corresponding to the switch 19, and the switch 20 so that the DC current originated from the external power source 2 is allowed to flow through the capacitor 18, the charging circuit 19, and the switch 20 after the AC-to-DC conversion. In the case where the switch 20 is switched over to the charging side opposite to the contacted side shown in FIG. 4, and the switch 19 is switched over to the charging side, the current originated from the external power source 2 is allowed to flow through the capacitor 18, whereby the capacitor 18 is charged, and the first fixing heater 17 is de-energized. When the switch 19 is switched over to the suspending side, the capacitor 18 is not charged even when the switch 20 is switched over to the charging side opposite to the contacted side shown in FIG. 4. In the case where the switch 20 is switched over to the discharging side as shown in FIG. 4, the current supply from the external power source 2 is cut off to thereby suspend the charging operation of the capacitor 18. At the same time, the current from the charged capacitor 18 is fed to the first fixing heater 17, thereby energizing the first fixing heater 17.

A circuit to be connected to the second fixing heater 22 includes the lithium ion battery 23, a charging circuit 24 corresponding to the switch 24, and the switch 25 so that the DC current originated from the external power source 2 is allowed to flow through the lithium ion battery 23, the charging circuit 24, and the switch 25 after the AC-to-DC conversion. In the case where the switch 25 is switched over to the charging side opposite to the contacted side shown in FIG. 4, and the switch 24 is switched over to the charging side, the current from the external source 2 is supplied to the lithium ion battery 23, whereby the lithium ion battery 23 is charged, and the second fixing heater 22 is de-energized. When the switch 24 is switched over to the suspending side, the lithium ion battery 23 is not charged, even when the switch 25 is switched over to the charging side. In the case where the switch 25 is switched over to the discharging side as shown in FIG. 4, the current supply from the external power source 2 is cut off to thereby suspend the charging operation of the lithium ion battery 23. At the same time, the current from the charged lithium ion battery 23 is fed to the second fixing heater 22, thereby energizing the second fixing heater 22.

A circuit to be connected to the third fixing heater 26 includes the third heater driving circuit 27 corresponding to the switch 27 so that the AC current originated from the external power source 2 is allowed to flow through the switch 27. In the case where the switch 27 is switched over to the inoperative side, the third fixing heater 26 is de-energized. On the other hand, in the case where the switch 27 is switched over to the operative side, the third fixing heater 26 is energized.

The circuit to be connected to the first fixing heater 17, and the circuit to be connected to the second fixing heater 22 are connected to each other by the switch 21. When the switch 21 is switched over to the operative side, and when both the switch 20 and the switch 25 are switched over to the charging sides, in other words, the power supply to the composite machine 1 is cut off, the current that has flowed through the lithium ion battery 23 is fed to the capacitor 18 via the charging circuit 19, thereby charging the capacitor 18.

Figure 5A:
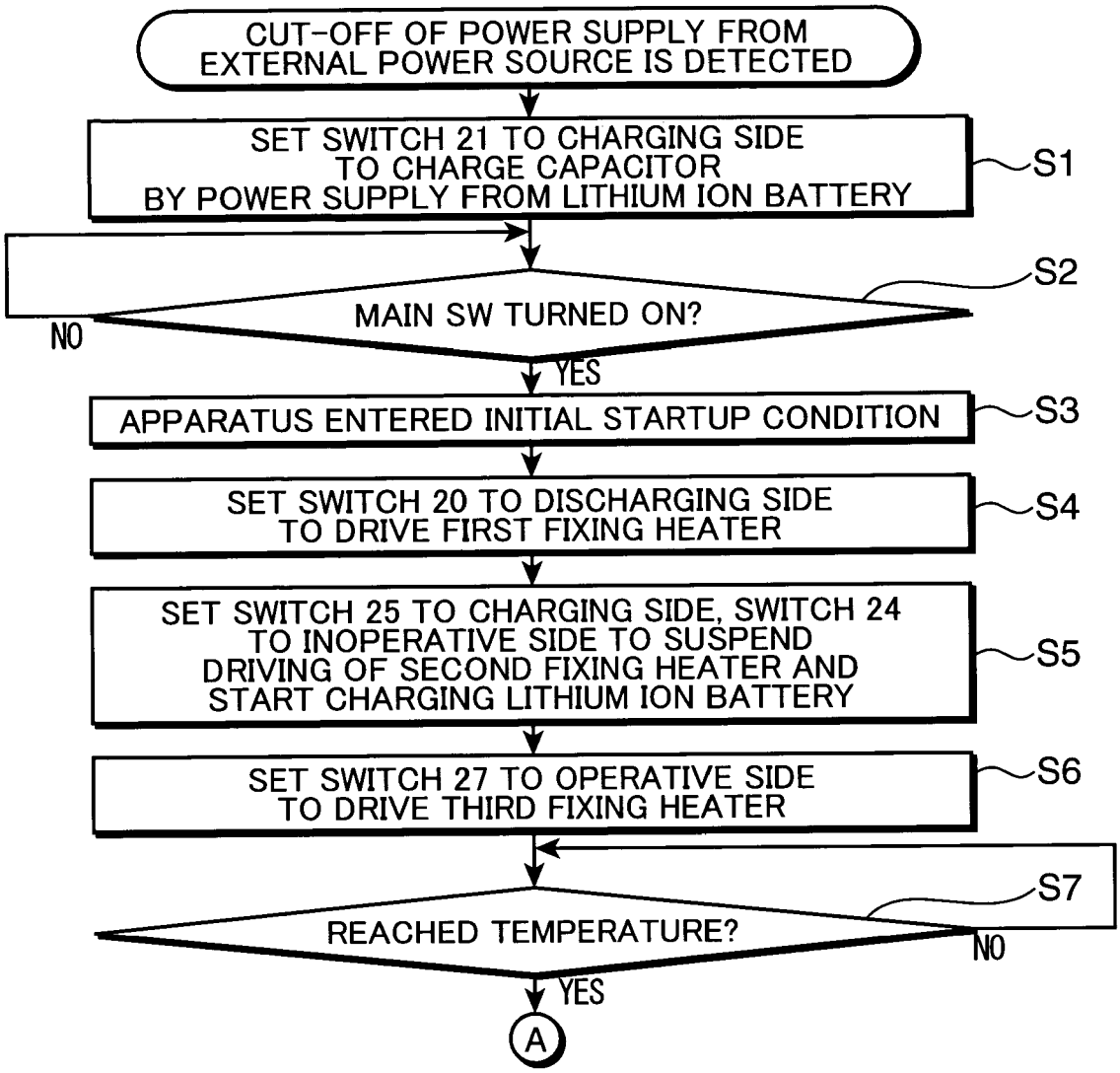
FIGS. 5A through 5C are flowcharts showing a processing flow on control of fixing heaters in the composite machine.
Figure 5B:
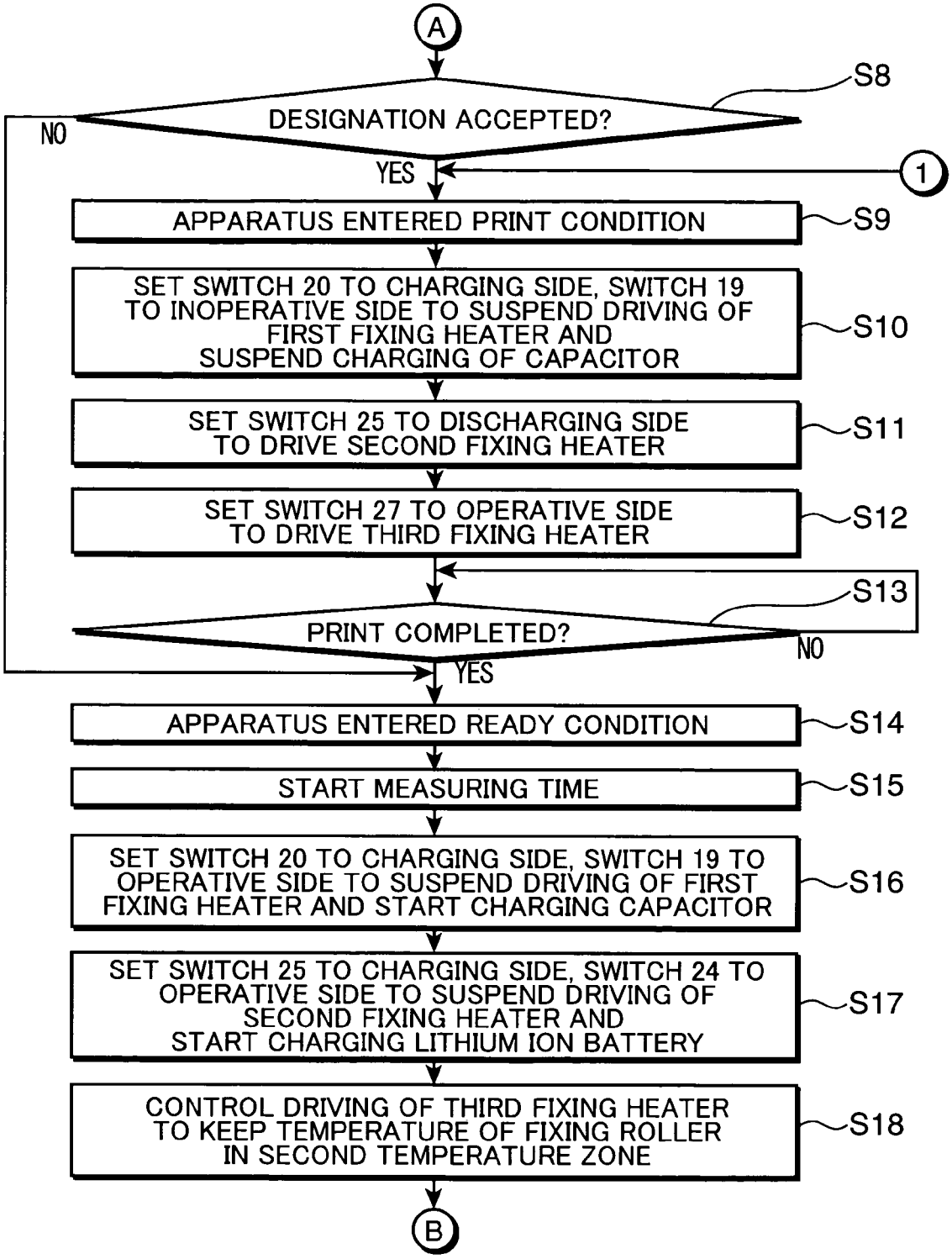
Figure 5C:
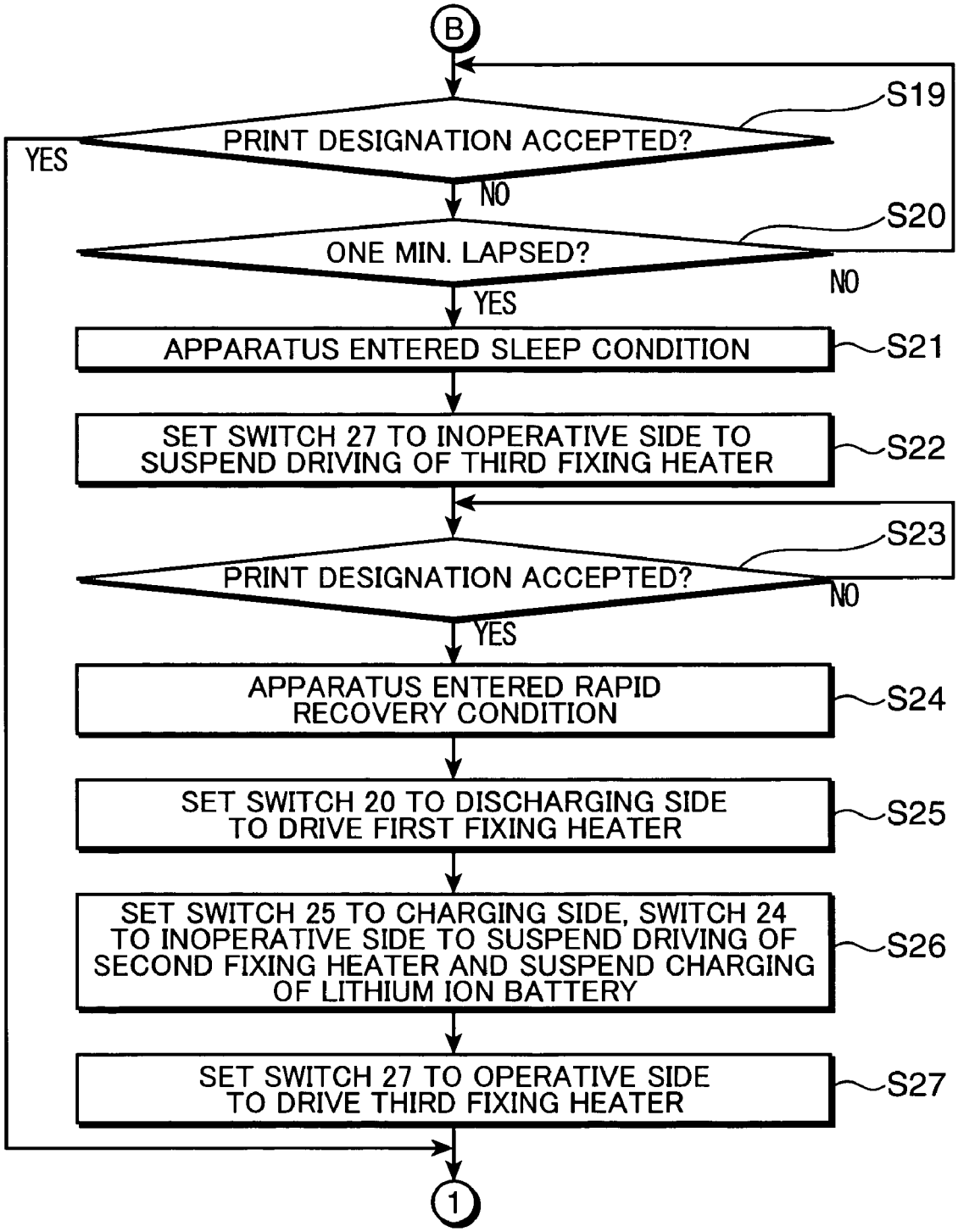

Now, a flow on controlling the fixing heaters is described. FIGS. 5A through 5C are flowcharts showing the flow on controlling the fixing heaters. The routine of the flowchart starts from the point of time when a current supply from the external power source 2 to the composite machine 1 is cut off while the composite machine 1 is in operation, in other words, when the main switch of the composite machine 1 is turned off, or the power plug is disconnected from the power source outlet.

After the current supply from the external power source 2 is cut off, the switch 21 is switched over to the charging side so that the capacitor 18 is charged by the lithium ion battery 23 (Step S1).

Then, the apparatus condition judger 152 judges whether an current is supplied from the external power source 2, in other words, the power plug is connected to the power source outlet, and the main switch of the composite machine 1 is turned on (Step S2). When the judgment result in Step S2 is negative (NO in Step S2), the judgment is cyclically repeated until the current is supplied from the external power source 2.

When the apparatus condition judger 152 judges that a current is supplied from the external power source 2 (YES in Step S2), the apparatus condition judger 152 judges that the composite machine 1 has entered the initial startup condition (Step S3). Then, the switch controller 153 controls the switch 20 to switch over to the discharging side to drive the first fixing heater 17 (Step S4).

Subsequently, the switch controller 153 controls the switch 25 to switch over to the charging side, and controls the switch 24 to switch over to the suspending side to suspend the driving of the second fixing heater 22 and the charging operation of the lithium ion battery 23 (Step S5). Then, the switch controller 153 controls the switch 27 to switch over to the operative side to drive the third fixing heater 26 (Step S6).

Thereafter, the fixing roller temperature controller 151 judges whether the temperature of the fixing roller (not shown) has reached the upper limit of the predetermined first temperature zone capable of image fixation (Step S7). When the judgment result in Step S7 is negative, the judgment is cyclically repeated until the fixing roller temperature controller 151 judges that the temperature of the fixing roller has reached the upper limit of the first temperature zone.

When the fixing roller temperature controller 151 judges that the temperature of the fixing roller has reached the upper limit (YES in Step S7), the apparatus condition judger 152 judges whether the image formation designation acceptor 12 has accepted a printing designation including a designation on copying and fax data receiving (Step S8). When it is judged that the image formation designation acceptor 12 has accepted the printing designation (YES in Step S8), the apparatus condition judger 152 judges that the composite machine 1 has entered the print condition (Step S9). Then, the switch controller 153 controls the switch 20 to switch over to the charging side, and controls the switch 19 to switch over to the suspending side to suspend the driving of the first fixing heater 17 and the charging operation of the capacitor 18 (Step S10).

Then, the switch controller 153 controls the switch 25 to switch over to the discharging side to drive the second fixing heater 22 (Step S11). Subsequently, the switch controller 153 controls the switch 27 to switch over to the operative side to drive the third fixing heater 26 (Step S12).

Thereafter, the apparatus condition judger 152 judges whether it has received a signal from the image forming section 11 that the printing has completed (Step S13). When the judgment result in Step S13 is negative (NO in Step S13), the judgment in Step S13 is cyclically repeated until the apparatus condition judger 152 receives the signal from the image forming section 11 that the printing has completed. When the apparatus condition judger 152 receives the signal from the image forming section 11 that the printing has completed (YES in Step S13), and when the apparatus condition judger 152 judges that the image formation designation acceptor 12 has not accepted another printing designation (NO in Step S8), then, the apparatus condition judger 152 judges that the composite machine 1 has entered the ready condition (Step S14).

The apparatus condition judger 152, then, controls the timer 13 to start measuring the time (Step S15). Thereafter, the switch controller 153 controls the switch 20 to switch over to the charging side, and controls the switch 19 to switch over to the charging side to suspend the driving of the first fixing heater 17 and to start charging the capacitor 18 (Step S16).

Then, the switch controller 153 controls the switch 25 to the charging side, and controls the switch 24 to switch over to the operative side to suspend the driving of the second fixing heater 22 and to start charging the lithium ion battery 23 (Step S17). Subsequently, the fixing roller temperature controller 151 controls energization and de-energization of the third fixing heater 26 so that the temperature of the fixing roller (not shown) is kept in the second temperature zone whose upper limit is lower than the lower limit of the first temperature zone capable of image fixation (Step S18).

Then, the apparatus condition judger 152 judges whether the image formation designation acceptor 12 has accepted a printing designation (Step S19). When the apparatus condition judger 152 judges that the image formation designation acceptor 12 has not accepted the printing designation (NO in Step S19), the apparatus condition judger 152 judges whether the time measured by the timer 13 has lapsed a certain time, e.g., 1 minute (Step S20). If the measured time has not lapsed one minute (NO in Step S20), the routine returns to Step S19. If, on the other hand, the measured time has lapsed one minute (YES in Step S20), the apparatus condition judger 152 judges that the composite machine 1 has entered the sleep condition (Step S21).

Then, the switch controller 153 controls the switch 27 to switch over to the inoperative side to suspend the driving of the third fixing heater 26 (Step S22). Thereafter, the apparatus condition judger 152 judges whether the image formation designation acceptor 12 has accepted a printing designation (Step S23). When the judgment result in Step S23 is negative (NO in Step S23), the judgment in Step S23 is cyclically repeated until the apparatus condition judger 152 judges that the image formation designation acceptor 12 has accepted a printing designation. When, on the other hand, the apparatus condition judger 152 judges that the image formation designation acceptor 12 has accepted a printing designation (YES in Step S23), the apparatus condition judger 152 judges that the composite machine 1 has entered the rapid recovery condition (Step S24). Then, the switch controller 153 controls the switch 20 to switch over to the discharging side to drive the first fixing heater 17 (Step S25).

Thereafter, the switch controller 153 controls the switch 25 to switch over to the charging side, and controls the switch 24 to switch over to the suspending side to suspend the driving of the second fixing heater 22 and the charging operation of the lithium ion battery 23 (Step S26). Then, the switch controller 153 controls the switch 27 to switch over to the operative side to drive the third fixing heater 26 (Step S27).

Then, on the other hand, the apparatus condition judger 152 judges that the image formation designation acceptor 12 has accepted a printing designation (YES in Step S19), and when the processing in Step S27 is completed, the routine returns to Step S9.

In the embodiment, when the composite machine 1 is in the rapid recovery condition where rapid temperature rise of the fixing roller is required, the rapid temperature rise of the fixing roller is accomplished by driving the third fixing heater 26 with power supply from the external power source 2, and by driving the first fixing heater 17 with power supply from the electric dual layer capacitor 18, which is a sub power source suitable for supplying a large current in a short period. Also, when the composite machine 1 is in the print condition, the temperature of the fixing roller can be stably maintained within the fixing temperature zone by driving the third fixing heater 26 with power supply from the external power source 2, and by driving the second fixing heater 22 with power supply from the lithium ion battery 23, which is a sub power source suitable for supplying a relatively small current for a long period. Further, when the composite machine 1 is in a condition where a current supply from the external power source 2 is cut off, namely, the main switch of the composite machine 1 is turned off, rapid temperature rise of the fixing roller can be accomplished even when the composite machine 1 is in the initial startup condition after turning on of the main switch of the composite machine 1, by charging the capacitor 18, which is likely to cause natural discharge, with power supply from the lithium ion battery 23.

The invention is not limited to the foregoing, but may be applicable to the following modifications. In the embodiment, the fixing heater connected to the external power source, the fixing heater connected to the electric dual layer capacitor, and the fixing heater connected to the lithium ion battery are provided individually. Alternatively, a common fixing heater, e.g., a single fixing heater may be connected to these three power sources, i.e., the external power source, the capacitor, and the lithium ion battery.

In the embodiment, a DC current is allowed to flow through the first fixing heater 17 and the second fixing heater 22, and an AC current is allowed to flow through the third fixing heater 26. The type of the current, i.e., AC current or DC current which is allowed to flow through the respective fixing heaters may be arbitrarily set.

In the embodiment, the switches 19 and 20 are so configured as to create three conditions, i.e., the condition that the first fixing heater 17 is driven, and the capacitor 18 is not charged, the condition that the driving of the first fixing heater 17 is suspended, and the capacitor 18 is charged, and the condition that the driving of the first fixing heater 17 is suspended, and the capacitor 18 is not charged. Likewise, the switches 24 and 25 are so configured as to create three conditions corresponding to the above three conditions relating to the second fixing heater 22 and the lithium ion battery 23. Alternatively, the above three conditions may be made by a single switch capable of switching over among three conditions.

As described above, an image forming apparatus comprises: a first sub power source including a capacitor; a second sub power source including a secondary battery; a first fixing heater for heating a fixing section to fix toner onto a recording sheet by an electric power supplied from the first sub power source; a second fixing heater for heating the fixing section by an electric power supplied from the second sub power source; a third fixing heater for heating the fixing section by an electric power supplied from an external power source as a main power source; a first charging switch for switching over charging and charge-suspending of the first sub power source; a second charging switch for switching over charging and charge-suspending of the second sub power source; a first charging/discharging switch for switching over discharging of the first sub power source to drive the first fixing heater, and charging of the first sub power source; a second charging/discharging switch for switching over discharging of the second sub power source to drive the second fixing heater, and charging of the second sub power source; a third heater driving switch for switching over driving of the third fixing heater by the electric power supplied from the external power source, and drive-suspending of the third fixing heater; an apparatus condition judger for judging whether the image forming apparatus is in a first condition where a rapid temperature rise is required to rapidly raise a temperature of the fixing section to a predetermined first temperature zone, or in a second condition where the temperature of the fixing section is required to be maintained in the first temperature zone; and a controller for controllably switching the first charging/discharging switch to the discharging, the second charging/discharging switch to the charging, the second charging switch to the charge-suspending, and the third heater driving switch to the driving when the apparatus condition judger judges that the apparatus is in the first condition, and for controllably switching the first charging/discharging switch to the charging, the first charging switch to the suspending, the second charging/discharging switch to the discharging, and the third heater driving switch to the driving when the apparatus condition judger judges that the apparatus is in the second condition.

With this arrangement, in the case where the temperature of the fixing section is required to be rapidly raised to the first temperature zone by supply of a large electric current to the image forming apparatus in a short period, the first and third fixing heaters are driven by the power supply from the external power source and from the first sub power source. In the case where the temperature of the fixing section is required to be maintained in the first temperature zone by supply of a relatively small electric current to the image forming apparatus for a long period, the second and third fixing heaters are driven by the power supply from the external power source and from the second sub power source. This arrangement enables to shorten the time required for the temperature of the fixing section to be raised to the first temperature zone, and to maintain the temperature of the fixing section in the first temperature zone. Since there is no likelihood that a large electric current may flow through the second sub power source, this arrangement eliminates unduly shortening of the useful life of the second sub power source. Also, providing the second sub power source eliminates the need that a large current should flow through the first sub power source for a long period. This arrangement eliminates use of a first sub power source with a large capacity or a costly first sub power source. Also, since this arrangement prevents the first and second sub power sources from being charged by the external power source when the image forming apparatus is in the first or second condition, the external power source is dedicatedly used for driving the third fixing heater, thereby securing an electric power sufficient for driving the third fixing heater.

Preferably, the first condition may correspond to a state where a designation to start an image formation by the image forming apparatus is accepted when the temperature of the fixing section is below a lower limit of the first temperature zone and until the temperature of the fixing section is raised to the first temperature zone, or correspond to a state where supply of the electric power from the main power source to the image forming apparatus is started and until the temperature of the fixing section is raised to a temperature within the first temperature zone, and the second condition may correspond to a state where the image formation is being executed by the image forming apparatus.

With this arrangement, in the case where the image forming apparatus is in the condition where the designation to start the image formation by the image forming apparatus is accepted when the temperature of the fixing section is below the lower limit of the first temperature zone and until the temperature of the fixing section is raised to the first temperature zone, or in the condition where the supply of the electric power from the main power source to the image forming apparatus is started in response to turning on of the main switch of the image forming apparatus and until the temperature of the fixing section is raised to the first temperature zone, the first and third fixing heaters are driven by the power supply from the external power source and from the first sub power source. In the case where the image forming apparatus is in the condition where the image formation by the image forming apparatus is being executed, the second and third fixing heaters are driven by the power supply from the external power source and from the second sub power source. This arrangement enables to shorten the time required for the temperature of the fixing section to be raised to the first temperature zone, and to maintain the temperature of the fixing section in the first temperature zone. Since there is no likelihood that a large electric current may flow through the second sub power source, this arrangement eliminates unduly shortening of the useful life of the second sub power source. Also, providing the second sub power source eliminates the need that a large current should flow through the first sub power source for a long period. This arrangement eliminates use of a first sub power source with a large capacity or a costly first sub power source. Also, since this arrangement prevents the first and second sub power sources from being charged by the external power source when the image forming apparatus is in the first or second condition, the external power source is dedicatedly used for driving the third fixing heater, thereby securing an electric power sufficient for driving the third fixing heater.

Preferably, the apparatus condition judger may further judge whether the image forming apparatus is in a third condition where the temperature of the fixing section lies within a second temperature zone having an upper limit lower than the lower limit of the first temperature zone, and the image formation is suspended, or in a fourth condition where the third heater driving switch is to be switched over to the inoperative side, and the controller may controllably switch the third heater driving switch to the driving, the first charging/discharging switch and the second charging/discharging switch to the charging, respectively, and the first charging switch and the second charging switch to the charging, respectively when the apparatus condition judger judges that the image forming apparatus is in the third condition.

Preferably, the apparatus condition judger may further judge whether the image forming apparatus is in a third condition where the temperature of the fixing section lies within a second temperature zone having an upper limit lower than the lower limit of the first temperature zone, and the image formation is suspended, or in a fourth condition where the third heater driving switch is to be switched over to the drive-suspending to suspend the driving of the third fixing heater, and the controller may controllably switch the third heater driving switch to the drive-suspending, the first charging/discharging switch and the second charging/discharging switch to the charging, respectively, and the first charging switch and the second charging switch to the charging, respectively when the apparatus condition judger judges that the image forming apparatus is in the fourth condition.

With these arrangements, in the case where the image forming apparatus is in the condition where the temperature of the fixing section lies within the second temperature zone, and the image formation is not executed by the image forming apparatus, or in the condition where the third heater driving switch is to be switched over to the drive-suspending to suspend the driving of the third fixing heater, the first and second sub power sources are charged by the external power source. This enables to charge both the first and second sub power sources by the external power source when neither the first sub power source nor the second sub power source is in operation.

Preferably, the apparatus condition judger may judge that the image forming apparatus has entered the fourth condition upon lapse of a predetermined time after the image forming apparatus has entered the third condition, and the controller may controllably switch the third heater driving switch to the drive-suspending based on the judgment by the apparatus condition judger.

Preferably, the apparatus condition judger may judge that the image forming apparatus has entered the first condition upon receiving the designation to start the image formation by an operator while the image forming apparatus is in the fourth condition.

Preferably, the image forming apparatus may further comprise a third charging switch for switching over charging and charge-suspending of the first sub power source. The controller controllably switches the third charging switch to the charge-suspending of the first sub power source to cut off the power supply from the second sub power source when it is judged that the main electric power is supplied to the image forming apparatus, and controllably switches the third charging switch to the charging to charge the first sub power source by the power supply from the second sub power source when it is judged that the main power supply to the image forming apparatus is cut off.

With this arrangement, in the case where the main power supply to the image forming apparatus is cut off, in other words, the main switch of the image forming apparatus is in an off-state, or the power plug is disconnected from the power source outlet, the first sub power source is charged by the second sub power source. This arrangement enables to partly support charging the first sub power source, which is required to be operated immediately after the main power supply to the image forming apparatus is started, but is likely to cause natural discharge, at the time when the main power is supplied to the image forming apparatus, which contributes to rapid temperature rise of the fixing section in response to the main power supply to the image forming apparatus.

Preferably, the first sub power source may include an electric dual layer capacitor, and the second sub power source may include a lithium ion battery.

With this arrangement, used as the first sub power source is the electric dual layer capacitor having a larger capacity and a longer dischargeable time as compared with an ordinary capacitor. This enables to make the capacity of the first sub power source larger, and the dischargeable time thereof longer. Also, used as the second sub power source is the lithium ion battery having a longer useful life than a nickel-hydride battery. This enables to extend the useful life of the second sub source.

This application is based on Japanese Patent Application No. 2005-95152 filed on Mar. 29, 2005, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a first sub power source including a capacitor;

a second sub power source including a secondary battery;

a first fixing heater for heating a fixing section to fix toner onto a recording sheet by an electric power supplied from the first sub power source;

a second fixing heater for heating the fixing section by an electric power supplied from the second sub power source;

a third fixing heater for heating the fixing section by an electric power supplied from an external power source serving as a main power source;

a first charging switch for switching over charging and charge-suspending of the first sub power source;

a second charging switch for switching over charging and charge-suspending of the second sub power source;

a third charging switch for switching over charging and charge-suspending of the first sub power source;

a first charging/discharging switch for switching over discharging of the first sub power source to drive the first fixing heater, and charging of the first sub power source;

a second charging/discharging switch for switching over discharging of the second sub power source to drive the second fixing heater, and charging of the second sub power source;

a third heater driving switch for switching over driving of the third fixing heater by the electric power supplied from the external power source, and drive-suspending of the third fixing heater;

an apparatus condition judger for judging whether the image forming apparatus is in a first condition where a rapid temperature rise is required to rapidly raise a temperature of the fixing section to a predetermined first temperature zone, or in a second condition where the temperature of the fixing section is required to be maintained in the first temperature zone; and a controller for controllably switching the first charging/discharging switch to the discharging, the second charging/discharging switch to the charging, the second charging switch to the charge-suspending, and the third heater driving switch to the driving when the apparatus condition judger judges that the apparatus is in the first condition, for controllably switching the first charging/discharging switch to the charging, the first charging switch to the charge-suspending, the second charging/discharging switch to the discharging, and the third heater driving switch to the driving when the apparatus condition judger judges that the apparatus is in the second condition, and controllably switches the third charging switch to the charge-suspending of the first sub power source by the power supply from the second sub power source when it is judged that the main electric power is supplied to the image forming apparatus, and controllably switches the third charging switch to the charging of the first sub power source by the power supply from the second sub power source when it is judged that the main power supply to the image forming apparatus is cut off.

2. The image forming apparatus according to claim 1, wherein the first condition corresponds to a state where a designation to start an image formation by the image forming apparatus is accepted when the temperature of the fixing section is below a lower limit of the first temperature zone and until the temperature of the fixing section is raised to the first temperature zone, or corresponds to a state where supply of the electric power from the main power source to the image forming apparatus is started and until the temperature of the fixing section is raised to the first temperature zone, and the second condition corresponds to a state where the image formation is being executed by the image forming apparatus.

3. The image forming apparatus according to claim 1, wherein the first sub power source includes an electric dual layer capacitor, and the second sub power source includes a lithium ion battery.

4. An image forming apparatus comprising:

a first sub power source including a capacitor;

a second sub power source including a secondary battery;

a first fixing heater for heating a fixing section to fix toner onto a recording sheet by an electric power supplied from the first sub power source;

a second fixing heater for heating the fixing section by an electric power supplied from the second sub power source;

a third fixing heater for heating the fixing section by an electric power supplied from an external power source serving as a main power source;

a first charging switch for switching over charging and charge-suspending of the first sub power source;

a second charging switch for switching over charging and charge-suspending of the second sub power source;

a first charging/discharging switch for switching over discharging of the first sub power source to drive the first fixing heater, and charging of the first sub power source;

a second charging/discharging switch for switching over discharging of the second sub power source to drive the second fixing heater, and charging of the second sub power source;

a third heater driving switch for switching over driving of the third fixing heater by the electric power supplied from the external power source, and drive-suspending of the third fixing heater;

an apparatus condition judger for judging whether the image forming apparatus is in a first condition where a rapid temperature rise is required to rapidly raise a temperature of the fixing section to a predetermined first temperature zone, or in a second condition where the temperature of the fixing section is required to be maintained in the first temperature zone, the first condition corresponding to a state where a designation to start an image formation by the image forming apparatus is accepted when the temperature of the fixing section is below a lower limit of the first temperature zone and until the temperature of the fixing section is raised to the first temperature zone, or corresponds to a state where supply of the electric power from the main power source to the image forming apparatus is started and until the temperature of the fixing section is raised to the first temperature zone, the second condition corresponds to a state where the image formation is being executed by the image forming apparatus, the apparatus condition judger further judges whether the image forming apparatus is in a third condition where the temperature of the fixing section lies within a second temperature zone having an upper limit lower than the lower limit of the first temperature zone, and the image formation is suspended, or in a fourth condition where the third heater driving switch is to be switched to the drive-suspending, and a controller for controllably switching the first charging/discharging switch to the discharging, the second charging/discharging switch to the charging, the second charging switch to the charge-suspending, and the third heater driving switch to the driving when the apparatus condition judger judges that the apparatus is in the first condition, and for controllably switching the first charging/discharging switch to the charging, the first charging switch to the charge-suspending, the second charging/discharging switch to the discharging, and the third heater driving switch to the driving when the apparatus condition judger judges that the apparatus is in the second condition, wherein the controller controllably switches the third heater driving switch to the driving, the first charging/discharging switch and the second charging/discharging switch to the charging, respectively, and the first charging switch and the second charging switch to the charging, respectively when the apparatus condition judger judges that the image forming apparatus is in the third condition.

5. The image forming apparatus according to claim 4, wherein the apparatus condition judger judges that the image forming apparatus has entered the fourth condition upon lapse of a predetermined time after the image forming apparatus has entered the third condition, and the controller controllably switches the third heater driving switch to the drive-suspending based on the judgment by the apparatus condition judger.

6. The image forming apparatus according to claim 4, wherein the apparatus condition judger judges that the image forming apparatus has entered the first condition upon receiving the designation to start the image formation by an operator when the image forming apparatus is in the fourth condition.

7. The image forming apparatus comprising:

a first sub power source including a capacitor;

a second sub power source including a secondary battery;

a first fixing heater for heating a fixing section to fix toner onto a recording sheet by an electric power supplied from the first sub power source;

a second fixing heater for heating the fixing section by an electric power supplied from the second sub power source;

a third fixing heater for heating the fixing section by an electric power supplied from an external power source serving as a main power source;

a first charging switch for switching over charging and charge-suspending of the first sub power source;

a second charging switch for switching over charging and charge-suspending of the second sub power source;

a first charging/discharging switch for switching over discharging of the first sub power source to drive the first fixing heater, and charging of the first sub power source;

a second charging/discharging switch for switching over discharging of the second sub power source to drive the second fixing heater, and charging of the second sub power source;

a third heater driving switch for switching over driving of the third fixing heater by the electric power supplied from the external power source, and drive-suspending of the third fixing heater;

an apparatus condition judger for judging whether the image forming apparatus is in a first condition where a rapid temperature rise is required to rapidly raise a temperature of the fixing section to a predetermined first temperature zone, or in a second condition where the temperature of the fixing section is required to be maintained in the first temperature zone, the first condition corresponding to a state where a designation to start an image formation by the image forming apparatus is accepted when the temperature of the fixing section is below a lower limit of the first temperature zone and until the temperature of the fixing section is raised to the first temperature zone, or corresponds to a state where supply of the electric power from the main power source to the image forming apparatus is started and until the temperature of the fixing section is raised to the first temperature zone, the second condition corresponds to a state where the image formation is being executed by the image forming apparatus, the apparatus condition judger further judges whether the image forming apparatus is in a third condition where the temperature of the fixing section lies within a second temperature zone lower than the first temperature zone, and the image formation is suspended, or in a fourth condition where the third heater driving switch is to be switched over to the drive-suspending, and a controller for controllably switching the first charging/discharging switch to the discharging, the second charging/discharging switch to the charging, the second charging switch to the charge-suspending, and the third heater driving switch to the driving when the apparatus condition judger judges that the apparatus is in the first condition, and for controllably switching the first charging/discharging switch to the charging, the first charging switch to the charge-suspending, the second charging/discharging switch to the discharging, and the third heater driving switch to the driving when the apparatus condition judger judges that the apparatus is in the second condition, wherein the controller controllably switches the third heater driving switch to the drive-suspending, the first charging/discharging switch and the second charging/discharging switch to the charging, respectively, and the first charging switch and the second charging switch to the charging, respectively when the apparatus condition judger judges that the image forming apparatus is in the fourth condition.

* * * * *